US006120967A

United States Patent [19]

Hopper et al.

[11] Patent Number: 6,120,967

[45] Date of Patent: Sep. 19, 2000

[54] SEQUENCED ADDITION OF COAGULANT IN TONER AGGREGATION PROCESS

[75] Inventors: Michael A. Hopper, Toronto; Raj D. Patel, Oakville; Lori Ann Rettinger, Cambridge; Tanya Jane Martin, Burlington, all of Canada

[73] Assignee: Xerox Corporation, Stamford, Conn.

[21] Appl. No.: 09/487,598

[22] Filed: Jan. 19, 2000

[51] Int. Cl.[7] ..... G03G 9/087

[52] U.S. Cl. ..... 430/137

[58] Field of Search ..... 430/137

[56] References Cited

U.S. PATENT DOCUMENTS

| | | | |
|---|---|---|---|
| 3,590,000 | 6/1971 | Palermiti et al. | 430/110 |
| 3,655,374 | 4/1972 | Palermiti et al. | 430/121 |
| 3,674,736 | 7/1972 | Lerman et al. | 264/117 |
| 3,720,617 | 3/1973 | Chatterji et al. | 430/110 |
| 3,944,493 | 3/1976 | Jadwin et al. | 430/109 |
| 3,983,045 | 9/1976 | Jugle et al. | 430/110 |
| 4,007,293 | 2/1977 | Mincer et al. | 428/407 |
| 4,079,014 | 3/1978 | Burness et al. | 430/110 |
| 4,394,430 | 7/1983 | Jadwin et al. | 430/110 |
| 4,560,635 | 12/1985 | Hoffend et al. | 430/106.6 |
| 4,935,326 | 6/1990 | Creatura et al. | 430/108 |
| 4,937,166 | 6/1990 | Creatura et al. | 430/108 |
| 5,278,020 | 1/1994 | Grushkin et al. | 430/137 |
| 5,290,654 | 3/1994 | Sacripante et al. | 430/137 |
| 5,308,734 | 5/1994 | Sacripante et al. | 430/137 |
| 5,344,738 | 9/1994 | Kmiecik-Lawrynowicz et al. | 430/137 |
| 5,346,797 | 9/1994 | Kmiecik-Lawrynowicz et al. | 430/137 |
| 5,348,832 | 9/1994 | Sacripante et al. | 430/137 |
| 5,364,729 | 11/1994 | Kmiecik-Lawrynowicz et al. | 430/137 |
| 5,366,841 | 11/1994 | Patel et al. | 430/137 |
| 5,370,963 | 12/1994 | Patel et al. | 430/137 |
| 5,391,456 | 2/1995 | Patel et al. | 430/137 |
| 5,403,693 | 4/1995 | Patel et al. | 430/137 |
| 5,405,728 | 4/1995 | Hopper et al. | 430/137 |
| 5,418,108 | 5/1995 | Kmiecik-Lawrynowicz et al. | 430/137 |
| 5,482,812 | 1/1996 | Hopper et al. | 430/137 |
| 5,496,676 | 3/1996 | Croucher et al. | 430/137 |
| 5,501,935 | 3/1996 | Patel et al. | 430/137 |
| 5,527,658 | 6/1996 | Hopper et al. | 430/137 |
| 5,585,215 | 12/1996 | Ong et al. | 430/137 |
| 5,622,806 | 4/1997 | Veregin et al. | 430/137 |
| 5,650,255 | 7/1997 | Ng et al. | 430/137 |
| 5,650,256 | 7/1997 | Veregin et al. | 430/137 |
| 5,744,520 | 4/1998 | Kmiecik-Lawrynowicz et al. | 430/137 |
| 5,827,633 | 10/1998 | Ong et al. | 430/137 |
| 5,863,698 | 1/1999 | Patel et al. | 430/137 |
| 5,922,501 | 7/1999 | Cheng et al. | 430/137 |
| 5,945,245 | 8/1999 | Mychajlowskij et al. | 430/137 |
| 5,977,210 | 11/1999 | Patel et al. | 430/137 |

*Primary Examiner*—Roland Martin

*Attorney, Agent, or Firm*—Oliff & Berridge, PLC; Eugene O. Palazzo

[57] ABSTRACT

A process for the preparation of a toner composition includes (i) forming a resin latex dispersion of a resin in an aqueous ionic surfactant solution from a latex utilizing an ionic surfactant and optionally a nonionic surfactant; (ii) preparing a pigment dispersion in water of a pigment dispersed in water and a nonionic dispersant, and optionally an ionic surfactant of the same polarity as that employed in preparing the resin latex dispersion of step (i); (iii) blending at least a portion of the resin latex dispersion with the pigment dispersion, and optionally a wax dispersion, to form a resin-pigment blend; (iv) adding a portion of a counterionic coagulant in an aqueous solution to the resin-pigment blend, while continuously subjecting the mixture to high shear, to induce a homogeneous gel of the resin-pigment blend, wherein the amount of the counterionic coagulant added is 25 to 90% by weight of a total amount of counterionic coagulant to be added during the process; (v) heating the sheared gel at temperatures below a glass transition temperature (Tg) of the resin while continuously stirring to form aggregate particles; (vi) following a period of time to permit stabilization of aggregate particle size, adding a remaining portion of the total amount of counterionic coagulant to be added during the process in one or more sequenced stages; (vii) adding any remaining portion of the resin latex dispersion; (viii) changing the pH with a base in order to stabilize the aggregates; and (ix) heating the aggregate particles at temperatures above the Tg of the resin followed by reduction of the pH with an acid to form coalesced particles of a toner composition.

23 Claims, No Drawings

SEQUENCED ADDITION OF COAGULANT IN TONER AGGREGATION PROCESS

BACKGROUND OF THE INVENTION

1. Field of the Invention

The invention relates to toner processes, and more specifically to aggregation and coalescence processes for the preparation of toner compositions. More in particular, the invention relates to a method of preparing a toner composition by the emulsion aggregation technique in which the ionic coagulant is added into the composition in stages instead of all at the same time during homogenization.

2. Discussion of Related Art

In forming toner compositions for use with reprographic or xerographic print devices, emulsion aggregation processes are known. For example, emulsion/aggregation/coalescing processes for the preparation of toners are illustrated in a number of Xerox patents, the disclosures of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797. Also of interest may be U.S. Pat. Nos. 5,348,832, 5,405,728, 5,366,841, 5,496,676, 5,527,658, 5,585,215, 5,650,255, 5,650,256 and 5,501,935 (spherical toners).

In addition, the following U.S. patents relate to emulsion aggregation processes of forming toner compositions, the disclosures of which are incorporated herein by reference in their entireties:

U.S. Pat. No. 5,922,501 describes a process for the preparation of toner comprising blending an aqueous colorant dispersion and a latex resin emulsion, and which latex resin is generated from a dimeric acrylic acid, an oligomer acrylic acid, or mixtures thereof and a monomer; heating the resulting mixture at a temperature about equal, or below about the glass transition temperature (Tg) of the latex resin to form aggregates; heating the resulting aggregates at a temperature about equal to, or above about the Tg of the latex resin to effect coalescence and fusing of the aggregates; and optionally isolating the toner product, washing, and drying.

U.S. Pat. No. 5,945,245 describes a surfactant free process for the preparation of toner comprising heating a mixture of an emulsion latex, a colorant, and an organic complexing agent.

U.S. Pat. No. 5,391,456 describes a process for the preparation of toner compositions comprising: (i) forming a dispersion of resin in an aqueous ionic surfactant solution; (ii) preparing pigment dispersions in water of three different pigments each of a dissimilar color, each dispersion being comprised of a pigment dispersed in water and which preparation utilizes nonionic dispersants, and optionally an ionic surfactant; (iii) blending the prepared resin dispersed as a latex with two, or optionally three of the different color pigment dispersions of step (ii); (iv) adding an aqueous solution of counterionic surfactant as a coagulant to the formed resin-pigment blends, while continuously subjecting the mixture to high shear, to induce a homogeneous gel of the flocculated resin-pigments blend; (v) heating the above sheared gel at temperatures between about 20° C. and about 5° C. below the glass transition temperature (Tg) of the resin while continuously stirring at speeds between about 200 and about 500 revolutions per minute to form statically bound toner sized aggregates between about 2 and about 12 microns in average volume diameter with a narrow size dispersity and with a geometric size distribution (GSD) between 1.10 and 1.25; (vi) heating the statically bound aggregated particles at temperatures of from between 25° C. and 40° C. above the Tg of the resin to form coalesced rigid particles of a toner composition comprised of polymeric resin, and pigment agent; and optionally (vii) separating and drying said toner.

U.S. Pat. No. 5,482,812 describes a process for the preparation of toner compositions or toner particles comprising: (i) providing an aqueous pigment dispersion comprised of a pigment, an ionic surfactant, and optionally a charge control agent; (ii) providing a wax dispersion comprised of wax, a dispersant comprised of nonionic surfactant, ionic surfactant or mixtures thereof; (iii) shearing a mixture of the wax dispersion and the pigment dispersion with a latex or emulsion blend comprised of resin, a counterionic surfactant with a charge polarity of opposite sign to that of said ionic surfactant and a nonionic surfactant; (iv) heating the above sheared blend below about the glass transition temperature (Tg) of the resin to form electrostatically bound toner size aggregates with a narrow particle size distribution; (v) adding additional ionic surfactant to the aggregated suspension of (iv) to ensure that no, or minimal additional particle growth of the electrostatically bound toner size aggregates occurs on further increasing the temperature to coalesce the aggregates into toner particles (vi); (vi) heating the mixture of (v) with bound aggregates above about or at the Tg of the resin; and optionally (vii) separating the toner particles from the aqueous slurry by filtration and thereafter optionally washing.

U.S. Pat. No. 5,403,693 describes a process for the preparation of toner compositions with controlled particle size comprising: (i) preparing a pigment dispersion in water, which dispersion is comprised of a pigment, an ionic surfactant in amounts of from about 0.5 to about 10 percent by weight of water, and an optional charge control agent; (ii) shearing the pigment dispersion with a latex mixture comprised of a counterionic surfactant with a charge polarity of opposite sign to that of said ionic surfactant, a nonionic surfactant, and resin particles, thereby causing a flocculation or heterocoagulation of the formed particles of pigment, resin, and charge control agent; (iii) stirring the resulting sheared viscous mixture of (ii) at from about 300 to about 1,000 revolutions per minute to form electrostatically bound substantially stable toner size aggregates with a narrow particle size distribution; (iv) reducing the stirring speed in (iii) to from about 100 to about 600 revolutions per minute, and subsequently adding further anionic or nonionic surfactant in the range of from about 0.1 to about 10 percent by weight of water to control, prevent, or minimize further growth or enlargement of the particles in the coalescence step (iii); and (v) heating and coalescing from about 5 to about 50° C. above about the resin glass transition temperature, Tg, which resin Tg is from between about 45° C. to about 90° C. and preferably from between about 50° C. and about 80° C. the statically bound aggregated particles to form said toner composition comprised of resin, pigment and optional charge control agent.

U.S. Pat. No. 5,977,210 describes a process for the preparation of ink compositions comprising the emulsion polymerization of monomer, water, surfactant, and initiator with stirring and heating to provide a latex; mixing therewith a pigment dispersion of pigment particles, water, and cationic surfactant; blending the mixture;

thereafter stirring the mixture; and subsequently adding additional anionic surfactant to stabilize the aggregate particles.

U.S. Pat. No. 5,622,806 describes a process for the preparation of toner compositions with controlled particle size comprising: (i) preparing a pigment dispersion in water, which dispersion is comprised of a pigment, an ionic surfactant in amounts of from about 0.5 to about 10 percent by weight to water, and an optional charge control agent; (ii) shearing the pigment dispersion with a latex mixture comprised of a counterionic surfactant with a charge polarity of opposite sign to that of said ionic surfactant, a nonionic surfactant, and resin particles, thereby causing a flocculation or heterocoagulation of the formed particles of pigment, resin, and charge control agent; (iii) stirring the resulting sheared viscous mixture of (ii) at from about 300 to about 1,000 revolutions per minute to form electrostatically bound substantially stable toiler size aggregates with a narrow particle size distribution; (iv) reducing the stirring speed in (iii) to from about 100 to about 600 revolutions per minute, and subsequently adding further anionic or nonionic surfactant in the range of from about 0.1 to about 10 percent by weight of water to control, prevent, or minimize further growth or enlargement of the particles in the coalescence step (v); (v) heating and coalescing from about 5° C. to about 50° C. above about the resin glass transition temperature, Tg, which resin Tg is from between about 45° C. to about 90° C., the statically bound aggregated particles to form said toner composition comprised of resin, pigment and optional charge control agent; (vi) washing the aggregated particles at a temperature of from about 15° C. to about 5° C. below the glass transition temperature of the resin, and subsequently filtering the aggregated particles until substantially all of the surfactant has been removed from the aggregated particles, followed by subsequent driving of the particles at a temperature of from about 15° C. to about 5° C. below the glass transition temperature of the resin; and (vii) subsequently adding to said toner product a first layer of a hydrophilic oxide, and a second layer of a hydrophobic oxide.

U.S. Pat. No. 5,863,698 describes a process for the preparation of toner comprising mixing a colorant containing a surfactant and a latex emulsion, and wherein the latex emulsion contains resin and a nonionic hydrolyzable surfactant; heating below about the resin latex glass transition temperature, followed by the addition of an anionic stabilizer, thereafter heating above about the resin glass transition temperature, and adjusting the pH of the resulting mixture of resin and colorant particles suspended in an aqueous phase containing anionic surfactant, cationic surfactant and nonionic hydrolyzable surfactant, wherein said pH is increased from about 1.7 to about 2.5 to about 6 to about 12 by adding a base during the heating above about said resin glass transition temperature wherein coalescence is being accomplished.

Finally, U.S. application Ser. No. 09/173,405 (D/98588), filed Oct. 15, 1998, incorporated herein by reference, describes a process for forming a toner by mixing a colorant, a latex emulsion and two coagulants, followed by aggregation and coalescence. The two coagulants preferably are polyaluminum hydroxy chloride and benzalkonium chloride.

None of the foregoing references describing emulsion aggregation processes for forming toner compositions describe adding the necessary counterionic coagulant in sequenced stages, and instead teach only that the coagulant is mixed into the composition at the same time prior to homogenization and aggregation. However, when adding all of the coagulant at the same time, it is difficult and time consuming to control the viscosity of the composition, and thus difficult to insure suitable homogenization and aggregation. In fact, if the composition becomes too high in viscosity, aggregation cannot be effected at all, and the composition must be disposed of.

SUMMARY OF THE INVENTION

It is an object of the present invention to develop a process for readily controlling the viscosity of the composition during and following coagulant addition and thereby readily insuring proper homogenization and aggregation of the toner composition. It is a further object of the present invention to develop such a process that can be conducted in short amounts of time and that is easily conducted.

These and other objects of the present invention are achieved by avoiding addition of the total amount of ionic coagulant at the same time in the process, and instead adding portions of the total amount of coagulant to be added at different points in time. That is, the coagulant to be added into the composition is added at different, sequenced stages.

These and other objects of the present invention are also achieved by also sequencing the addition of the total amount of latex in different stages.

DETAILED DESCRIPTION OF PREFERRED EMBODIMENTS

Specifically, the present invention provides a process for the preparation of a toner composition comprising (i) forming a resin latex dispersion of a resin in an aqueous ionic surfactant solution from a latex utilizing an ionic surfactant and optionally a nonionic surfactant; (ii) preparing a pigment dispersion in water of a pigment dispersed in water and a nonionic dispersant, and optionally an ionic surfactant of the same polarity as that employed in preparing the resin latex dispersion of step (i); (iii) blending the resin latex dispersion with the pigment dispersion, and optionally a wax dispersion, to form a resin-pigment blend; (iv) adding a portion of a counterionic coagulant in an aqueous solution to the resin-pigment blend, while continuously subjecting the mixture to high shear, to induce a homogeneous gel of the resin-pigment blend, wherein the amount of the counterionic coagulant added is 25 to 90% by weight of a total amount of counterionic coagulant to be added in the process; (v) heating the sheared gel at temperatures below a glass transition temperature (Tg) of the resin while continuously stirring to form aggregate particles; (vi) following a period of time to permit stabilization of aggregate particle size, adding a remaining portion of the total amount of counterionic coagulant to be added in the process in one or more sequenced stages; (vii) changing the pH of the slurry to greater than a pH of 5.5, and preferably in the range of 6 to 9 and more preferably 6.1 to 8, to stabilize the particles to growth; (viii) heating the aggregate particles at temperatures above the Tg of the resin, followed by a reduction in pH to about 2.5 to 4.5 and preferably 3.0 to 4.3 to form coalesced particles of a toner composition; and (ix) optionally separating and drying the toner composition.

While the foregoing process relates solely to the delayed addition of portions of the counterionic coagulant, the process is most preferably carried out by also effecting delayed addition of a portion of the latex in the process. Thus, in the most preferred embodiment of the invention, the process for the preparation of a toner composition comprises: (i) forming a resin latex dispersion of a resin in an aqueous ionic surfactant solution from a latex utilizing an ionic surfactant and optionally a nonionic surfactant; (ii) preparing a pigment dispersion in water of a pigment dispersed in water and a nonionic dispersant, and optionally an ionic surfactant of the same polarity as that employed in preparing the resin latex dispersion of step (i); (iii) blending 70 to 99% by weight of a total amount of the resin latex dispersion to be added in the process with the pigment dispersion, and optionally a wax dispersion, to form a resin-pigment blend; (iv) adding a portion of a counterionic coagulant in an aqueous solution to the resin-pigment blend, while continuously subjecting the mixture to high shear, to induce a homogeneous gel of the resin-pigment blend, wherein the amount of the counterionic coagulant added is 25 to 90% by weight of a total amount of counterionic coagulant to be added in the process; (v) heating the sheared gel at temperatures below a glass transition temperature (Tg) of the resin while continuously stirring to form aggregate particles; (vi) following a period of time to permit stabilization of aggregate particle size, adding a remaining portion of the total amount of counterionic coagulant to be added in the process in one or more sequenced stages; (vii) following completion of the adding of all of the counterionic coagulant, adding a remaining portion of the total amount of resin latex dispersion to be added in the process; (viii) change the pH of the slurry to greater than a pH of 5.5, and preferably in the range of 6 to 9 and more preferably 6.1 to 8, to stabilize the particles to growth; (ix) then heating the aggregate particles at temperatures above the Tg of the resin, followed by a reduction in pH to about 2.5 to 4.5 and preferably 3.0 to 4.3 to form coalesced particles of a toner composition; and (x) optionally separating and drying the toner composition.

Except for the delayed addition of latex in the latter process, each of the steps of the processes is similar. Thus, the steps of the embodiments of the process of the present invention will now be described together below.

The resin of the toner composition is used in latex form. Preferably, the resin latex dispersion comprises the resin particles dispersed in an aqueous medium that also contains an ionic surfactant, most preferably an anionic surfactant, and optionally also contains a nonionic surfactant.

Illustrative examples of resin particles selected for the process of the present invention include known polymers selected from the group consisting of poly (styrenebutadiene), poly(para-methyl styrenebutadiene), poly(meta-methyl styrenebutadiene), poly(alpha-methyl styrene-butadiene), poly(methylmethacrylate-butadiene), poly(ethylmethacrylate-butadiene), poly (propylmethacrylate-butadiene), poly(butylmethacrylate-butadiene), poly(methylacrylate-butadiene), poly (ethylacrylate-butadiene), poly(propylacrylate-butadiene), poly(butylacrylate-butadiene), poly(styrene-isoprene), poly (para-methyl styrene-isoprene), poly(meta-methyl styrene-isoprene), poly(alpha-methylstyrene-isoprene), poly (methylmethacrylate-isoprene), poly(ethylmethacrylate-isoprene), poly(propylmethacrylate-isoprene), poly (butylmethacrylate-isoprene), poly(methylacrylate-isoprene), poly(ethylacrylate-isoprene), poly (propylacrylate-isoprene), and poly(butylacrylate-isoprene); and terpolymers such as poly(styrene-butadiene-acrylic acid), poly(styrene-butadiene-methacrylic acid), PLIOTONE available from Goodyear, polyethylene-terephthalate, polypropylene-terephthalate, polybutylene-terephthalate, polypentylene-terephthalate, polyhexalene-terephthalate, polyheptadene-terephthalate, polyoctalene-terephthalate, POLYLITE (Reichhold Chemical Inc.), PLASTHALL (Rohm & Haas), CYGAL (American Cyanamide), ARMCO (Armco Composites), ARPOL (Ashland Chemical), CELANEX (Celanese Eng), RYNITE (DuPont), and STYPOL.

The resin particles selected, which generally can be in embodiments styrene acrylates, styrene butadienes, styrene methacrylates, or polyesters are present in various effective amounts, such as from about 70 weight percent to about 98 weight and preferably between 80 and 92 percent of the toner, and can be of small average particle size such as from about 0.01 micron to about 1 micron in average volume diameter as measured by the Brookhaven nanosize particle analyzer. Other effective amounts of resin can be selected.

The resin particles selected for the process of the present invention are preferably prepared by, for example, emulsion polymerization techniques, including semi-continuous emulsion polymerization methods, and the monomers utilized in such processes can be selected from, for example, styrene, acrylates, methacrylates, butadiene, isoprene, and optionally acid or basic olefinic monomers such as acrylic acid, methacrylic acid, acrylamide, methacrylamide, quaternary ammonium halide of dialkyl or trialkyl acrylamides or methacrylamide, vinylpyridine, vinylpyrrolidone, vinyl-N-methylpyridinium chloride and the like. The presence of acid or basic groups in the monomer, or polymer resin is optional and such groups can be present in various amounts of from about 0.1 to about 10 percent by weight of the polymer resin. Chain transfer agents such as dodecanethiol or carbon tetrabromide, can also be selected when preparing resin particles by emulsion polymerization. Other processes of obtaining resin particles of from about 0.01 micron to about 1 micron can be selected from polymer microsuspension process, such as illustrated in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding process, or other known processes.

Examples of anionic surfactants suitable for use in the resin latex dispersion include, for example, sodium dodecylsulfate (SDS), sodium dodecylbenzene sulfonate, sodium dodecylnaphthalenesulfate, dialkyl benzenealkyl, sulfates and sulfonates, abitic acid, available from Aldrich, NEOGEN RK, NEOGEN SC from Kao and the like. An effective concentration of the anionic surfactant generally employed is, for example, from about 0.01 to about 10 percent by weight, and preferably from about 0.1 to about 5 percent by weight of monomers used to prepare the toner polymer resin.

Examples of nonionic surfactants that may be included in the resin latex dispersion include, for example, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol (available from Rhodia as IGEPAL CA-210, IGEPAL CA-520, IGEPAL CA-720, IGEPAL CO-890, IGEPAL CO-720, IGEPAL CO-290, IGEPAL CA-210, ANTAROX 890 and ANTAROX 897. A suitable concentration of the nonionic surfactant is, for example, from about 0.01 to about 10 percent by weight, and preferably from about 0.1 to about 5 percent by weight of monomers used to prepare the toner polymer resin.

The solids content of the resin latex dispersion is not particularly limited. The solids content may be from, for example, 10 to 90%.

The pigment dispersion of the invention is not particularly limited in composition or method of preparation. The pigment dispersion should most preferably comprise pigment particles dispersed in an aqueous medium with a nonionic dispersant/surfactant. A dispersant having the same polarity as that of the resin latex dispersion might also be used.

In some instances, pigments are available in the wet cake or concentrated form containing water, and can be easily dispersed utilizing a homogenizer or simply by stirring. In other instances, pigments are available only in a dry form, whereby dispersion in water is effected by microfluidizing using, for example, a M-110 microfluidizer or an ultimizer and passing the pigment dispersion from 1 to 10 times through the chamber, or by sonication, such as using a Branson 700 sonicator, or a homogenizer with the optional addition of dispersing agents such as the aforementioned ionic or nonionic surfactants.

Various known colorants or pigments present in the toner in an effective amount of, for example, from about 1 to about 25 percent by weight of the toner, and preferably in an amount of from about 1 to about 15 weight percent, that can be selected include known cyan, magenta, yellow, red, green, and blue pigments. Specific examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAperm YELLOW FGL, HOSTAPERM PINK E from Clariant, and CINQUASIA MAGENTA available from E. I. DuPont de Nemours & Company, and the like. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. The pigments selected are present in various effective amounts, such as from about 1 weight percent to about 65 weight and preferably from about 2 to about 12 percent of the toner.

Any suitable dispersant may be used in the pigment dispersion, including the nonionic and/or anionic surfactants identified above. Also, there is no particular limitation upon the solids content of the pigment dispersion. The solids content may range from, for example, 10 to 90%.

The resin latex dispersion and the pigment dispersion are first blended together. Any well known type of wax dispersion might also optionally be included in this blend including, for example, an aqueous based polyethylene wax containing an anionic surfactant as a dispersant. The blending obtains a resin-pigment blend. The blending may be effected by any suitable means known in the art, including stirring.

Emulsion aggregation processes for making chemical toners require the utilization of a certain quantity of ionic coagulant having an opposite polarity to an ionic surfactant in the latex (i.e., a counterionic coagulant), typically cationic coagulant, to ensure that the latex containing the ionic surfactant, typically anionic surfactant, is completely aggregated into toner particles. This quantity of coagulant has to be present in order to prevent the appearance of fines in the final slurry, i.e., small sized particles of less than about 1 micron in average volume diameter, which fines can adversely affect toner yield.

Counterionic coagulants may be comprised of either organic or inorganic entities or a combination of both which have an opposite polarity to the ionic surfactant used in the resin latex dispersion. For example, in the preferred embodiment of the present invention, the ionic surfactant of the resin latex dispersion is an anionic surfactant, and thus the counterionic surfactant coagulant is a cationic surfactant. However, the cationic surfactant may be in the latex and the anionic surfactant may then serve as the coagulant.

Examples of the cationic surfactants include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quatemized polyoxyethylalkylamines, dodecylbenzyl triethyl ammonium chloride, MIRAPOL and ALKAQUAT available from Alkaril Chemical Company, SANIZOL B (benzalkonium chloride), available from Kao Chemicals, and the like, and mixtures thereof.

Inorganic preferred cationic coagulants include, for example, poly-aluminum chloride (PAC), aluminum sulfate, zinc sulfate, or magnesium sulfate. The coagulant is preferably in an aqueous medium in an amount of from, for example, 0.05 to 10% by weight and more preferably in the range of 0.075 to 2.0% by weight. The coagulant may also contain minor amounts of other components, for example nitric acid.

In a further aspect of the invention, the coagulant may comprise a mixture of both an inorganic and an organic coagulant including, for example, PAC and SANIZOL B, aluminum sulfate and SANIZOL B, etc. Such mixtures of coagulants are also preferably used in an aqueous medium, each present in an amount of from, for example, 0.05 to 2.0% by weight.

The cationic surfactant is utilized in various effective amounts, such as for example from about 0.1 to about 10 percent and preferably between about 0.1 and 5 percent by weight of water. Preferably, the molar ratio of the cationic surfactant used for coagulation is related to the total amount of anionic surfactant used in the preparation of the resin latex dispersion and is in a range of, for example, 0.5 to 4, preferably from 0.5 to 2.

In the process of the invention, only a portion of the total amount of coagulant to be added in the process is added into the initial aggregation step of the process. The amount of coagulant initially added must be sufficient to impart a desired viscosity to the system to avoid the formation of an excessive amount of fines which may occur if the viscosity is too low, i.e., an insufficient amount of coagulant is initially added, and to avoid insufficient homogenization being achieved which may occur if the viscosity is too high, i.e., too much coagulant is initially added. A desired viscosity range is in the range of, for example, 50 to 1000 centipoise. The amount of coagulant initially added into the process for the aggregation step is, for example, 25 to 90% by weight of the total amount of coagulant to be added in the process. This initial amount of coagulant is blended into the resin-pigment blend.

The coagulant is preferably added slowly into the blend while continuously subjecting the blend to high shear, for example by stirring with a blade at about 3,000 to 10,000 rpm, most preferably about 5,000 rpm, for 1 to 120 minutes. A high shearing device, for example an intense homogenization device such as the in-line IKA SD-41, may be used to ensure that the blend is homogeneous and uniformly dispersed. This high shear effects homogenization of the resin-pigment blend.

Following homogenization, aggregation of the homogenized composition is effected by heating the composition to a temperature below the glass transition temperature (Tg) of the resin of the latex while agitating the composition. Most preferably, the temperature of the heating is from, for example, 5° C. to 20° C. below the Tg of the resin. The agitation preferably comprises continuously stirring the mixture using a mechanical stirrer at between, for example, 200 to 800 rpm.

The aggregation is conducted for a period of time until the aggregate particle size is stabilized, which may be for from, for example, 10 minutes to 6 hours.

Following stabilization of the aggregate particle size, the remaining portion of the coagulant is added in one or more addition stages. In each stage, the portion of coagulant to be added in that stage is again preferably metered slowly into the composition.

It has been found that the delayed addition of coagulant can be conducted in the invention by increasing the solids content of the latex-pigment dispersion, i.e., by using less water to dilute the latex prior to coagulation. For example, whereas conventional processes are conducted at solids contents of less than 15%, the present process is conducted at solids contents of greater than 15%, preferably at about 17%. The combination of higher solids content and lower amount of initial coagulant allows for effective homogenization and aggregation with minimal occurrences of fines.

The delayed addition of coagulant helps in overcoming the viscosity issue as well as the reduction of the fines level and improving the GSD. This is because if insufficient coagulant is added to the initial latex-pigment dispersion, while the viscosity of the aggregated slurry remains low and manageable, undesirable fines may be formed. The higher solids content preferably used helps to alleviate the formation of fines to a significant extent. However, the fines content may still be slightly too high following the initial aggregation step. This is addressed in the invention by adding the remaining coagulant after the initially formed aggregates are stable in aggregate size. The additional coagulant is added in one or more additional stages, along with optional additional amounts of water. This ensures that the fines formed in the initial aggregation are fully incorporated into the particles. An acceptable GSD can thus be obtained.

If necessary during addition of the coagulant, either initially or during one of the subsequent addition stages, additional water may be added into the composition if necessary in order to lower and/or maintain the viscosity of the composition within acceptable limitations. The amount of additional water added is preferably kept to a minimum since such added water must be later removed, and the removal takes a longer amount of time the greater the amount of water is.

Following aggregation and addition of all of the remaining delayed components into the composition, the particles are preferably coalesced by first changing the pH of the composition to a pH greater than 5.5, preferably to about 6.0 to 8.0, in order to stabilize the aggregates from further growth, followed by heating at a temperature above the Tg of the resin in the toner particles. Preferably, the heating for coalescing is conducted at a temperature of from 1 0° C. to 50° C., preferably 25° C. to 40° C., above the Tg of the resin for 30 minutes to 10 hours.

Preferably during the coalescence, the pH is increased for example in the range from about 1.8 to 3.0 to about 5.5 to 8.0 and preferably from the range of 2.0 to 2.8 to about 6.5 to 7.8 using any suitable pH increasing agent, for example sodium hydroxide. The increase in pH acts to stabilize the aggregate particle and prevents any further growth and loss of GSD during further heat up, for example when raising the temperature 10 to 50° C. above the resin Tg. After 15 to 60 mins at the coalescence temperature, the pH is then gradually decreased back in the range of 3.0 to 4.5, wherein the reduction in pH permits the coalescence or the fusion process. The preferred pH reducing agents include for example, nitric acid, citric acid, sulfuric acid, hydrochloric acid, and the like.

In an embodiment of the present invention, there resides a process of preparing a chemical toner, wherein the blending and aggregation steps are performed in the range of 1.8 to 3.0 and preferably in the range of 2.0 to 2.8, while the coalescence step is initially conducted in the pH range of 6.5 to 8.0 followed by a reduction in pH to a range of 3.0 to 4.5.

In a preferred embodiment in the present invention, a multi-stage addition of latex is conducted. In particular, only a portion of the total amount of latex to be added into the composition is initially present in the composition subjected to homogenization and aggregation. In this embodiment, a majority of the latex is added at the onset while the remainder of the latex (the delayed latex) is added after the formation of the resin-pigment aggregates.

This delayed addition of latex improves formation of an outer shell of non-pigmented material around the pigmented core, thereby better encapsulating the pigment in the core of the particles and away form the toner particles surface, where the presence of pigment can modify the charging behavior of the final toner particle. In other words, the addition of the remaining portion of the latex forms an outer shell around the already aggregated core particles.

However, the delayed latex scheme complicates the early phases of the latex aggregation process as it was thought that all of the coagulant must be added into the initial latex-pigment blend prior to the addition of any delayed latex because if coagulant were to be added later than the delayed latex, small aggregates that are detached from the original aggregated particles would tend to undesirably form.

The amount of delayed latex added may be as much as, for example, 30% of the total amount of latex to be added. That is, only 70 to 99% of the latex is initially added into the blend for homogenization and aggregation. This is problematic with respect to the addition of the entire amount of counterionic coagulant at the onset because when sufficient coagulant for the total amount of latex ultimately to be added is added into the initial latex-pigment dispersion, the viscosity of the system becomes too high and adequate homogenization cannot be achieved unless time consuming and difficult procedures are undertaken to control the viscosity. This is particularly so with respect to latexes having particle sizes therein of less than 180 nm and latexes formed by a semi-continuous or a batch emulsion polymerization process.

Homogenization is essential to ensure the formation of particles with a narrow geometric size distribution (GSD), and insufficient homogenization may give rise to the formation of unwanted large sized aggregates.

On the other hand, however, if insufficient coagulant is added to the initial latex-pigment dispersion, while the viscosity of the aggregated slurry remains low and manageable, undesirable fines are often formed.

The delayed addition of coagulant scheme discussed above is particularly well suited to managing the initial aggregation process step in a delayed latex incorporation scheme.

Following addition of all of the coagulant, the delayed latex can then be added to form the remaining shell of latex of the toner particles. By delaying addition of the coagulant, the particles are placed in excellent condition such that addition of the delayed amount of latex coats the existing particles to form an outer shell thereon rather than forming small aggregates of pure latex.

Following the pH changes as described above, the coalesced toner particles obtained may optionally be separated and dried by any technique known in the art. The particles may also be washed with, for example, hot water to remove surfactant, and dried such as by use of an Aeromatic fluid bed dryer.

The toner particles of the invention may also include known charge additives in effective amounts of, for example, from 0.1 to 5 weight percent such as alkyl pyridinium halides, bisulfates, the charge control additives of U.S. Pat. Nos. 3,944,493, 4,007,293, 4,079,014, 4,394,430 and 4,560,635, the disclosures of which are totally incorporated herein by reference, and the like. Surface additives that can be added to the toner compositions after washing or drying include, for example, metal salts, metal salts of fatty acids, colloidal silicas, metal oxides, mixtures thereof and the like, which additives are usually present in an amount of from about 0.1 to about 2 weight percent, reference U.S. Pat. Nos. 3,590,000, 3,720,617, 3,655,374 and 3,983,045, the disclosures of which are totally incorporated herein by reference. Preferred additives include zinc stearate and AEROSIL R972.R available from Degussa in amounts of from 0.1 to 2 percent which can be added during the aggregation process or blended into the formed toner product.

Developer compositions can be prepared by mixing the toners obtained with the process of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Another advantage of the process of the present invention is that although it has been proposed to control the viscosity of the composition during addition of the coagulant by increasing the pH of the composition during the addition/aggregation phase (see Procedure (ii) below), the present process eliminates the need for such difficult and time consuming viscosity control.

By the process of the invention, toner particles of acceptable size and narrow dispersity are obtained in a more rapid method than previously realized in the art. The toner particles preferably have an average volume diameter of from about 0.5 to about 25, and preferably from 1 to about 10 microns, and a narrow GSD characteristic of from about 1.05 to about 1.25, and preferably of from 1.15 to 1.25 as measured by a Coulter Counter. The toner particles also have an excellent shape factor, for example of 120 or less. The shape factor is a measure of smoothness and roundness, a shape factor of 100 being considered perfectly spherical and smooth, while a shape factor of 140 is considered to be rough in surface morphology and the shape is like a potato and is usually measured by a microscope. The shape factor of the toner of the present invention indicates that a very spherical shape of toner is obtained. The resulting toners can be selected for known electrophotographic imaging and printing processes, including color processes, and lithography.

The following Examples illustrate the embodiments and advantages of the present invention. Parts and percentages are by weight unless otherwise indicated.

EXAMPLES

In the example and comparative examples, the following materials are used.

Latex Formation Procedure

A semi-continuous latex is synthesized at 40% solids loading using ammonium persulfate as an initiator and dodecane thiol as chain transfer agent using styrene, butyl acrylate, acrylic acid as the reactive ingredients. The mass ratio of the reactive monomers is 81:17:1.5 for sytrene, butyl acrylate and acrylic acid, respectively. The latex has a Mw of 30 k and a Tg of 53° C. with a particle size of 100 nm and a pH of 1.8, and containing 1.0% DOWFAX anionic surfactant.

Wax and Pigment Dispersions

The aqueous wax dispersion utilized in these examples is made using P725 polyethylene wax and Neogen RK as an anionic surfactant/dispersant. The particle size is determined to be approximately 200 nm and the wax slurry is supplied with a solid loading of 30%.

The pigment dispersion utilized is an aqueous dispersion of B 15:3 cyan pigment supplied from Sun Chemicals. This pigment dispersion utilizes a proprietary nonionic dispersant and the pigment content of the dispersion as supplied is 48%.

Example 1

Toner Aggregation Procedure 500 gm of latex contains 200 gm of polymer resin and it has been established that this quantity of latex requires 3 gm of a 10% w/w PAC (poly-aluminum chloride) solution to most effectively coagulate the latex. Utilization of less PAC results in poor incorporation of the delayed latex that counters the original purpose of adding that quantity of material as a shell around the pigmented particle core.

The following three procedures provide evidence for the effectiveness of the process outlined in this invention. In each case it is desired to have a pigment loading of 4% and a wax loading of 8% in the final 5.2 micron sized particle and to have 30% of the latex added after the initial formation of the particles so that 30% of the resin volume is in the "shell" of the particle. The three procedures are comparative (i): the addition of all the PAC coagulant to the initial latex-pigment slurry as has been performed for most of the EA toner particle processing in the past, comparative (ii): a procedure involving starting with a pH adjustment to the latex-pigment slurry, addition of all the required coagulant at the same time and continuously adjusting the pH as the aggregation proceeds and example (iii): the procedure of the invention involving addition of coagulant and water as the aggregation proceeds.

Comparative Procedure (i): Failure of aggregation because of high viscosity 350 gm of latex and 60 gm of the wax dispersion are added to 500 gm of water and mixed well. 20 gm of pigment dispersion is added to 100 gm of water and added to the latex-wax blend. At this stage the solids content of the blend is 14% w/w. 3 gm of a 10% PAC solution in 20 gm of 0.2 N nitric acid is added slowly to the wax-pigment-latex blend while homogenizing at 5000 rpm.

The viscosity of the blend becomes so high that homogenization fails and the blend has the form of cottage cheese. The viscosity of this blend is so high it cannot be agitated.

Comparative Procedure (ii) (Total time for aggregation at 48° C. to reach a particle size of 5.2 microns is 6 hr.)

350 gm of latex and 60 gm of the wax dispersion is added to 500 gm of water and mixed well. 20 gm of pigment dispersion is added to 100 gm of water and added to the latex-wax blend. At this stage the solids content of the blend is 14% w/w. At this point the pH of the blend is changed from 1.8 to 4.0 by adding sodium hydroxide (4% w/w solution). 3 gm of a 10% PAC solution in 20 gm of 0.2 N nitric acid is added slowly to the wax-pigment-latex blend while homogenizing at 5000 rpm. The blend at this stage has quite low viscosity and is transferred into a reactor and heated to a temperature of 48° C. The viscosity of the slurry increases as the temperature is raised but can be agitated sufficiently well to ensure adequate temperature uniformity of the slurry.

Once the system reaches the aggregation temperature, a particle size analysis shows that there are many fines in the system and the pH of the slurry is reduced to 3.8 by the addition of a dilute nitric acid solution. This causes an increase in the viscosity that remains high for more than 30 minutes before decreasing slightly.

Over the next four hours the pH is successively reduced from 3.8 to 3.2 in steps of 0.2 units. Dramatic decreases of pH in this stage of the procedure results in the formation of excessively viscous slurry that cannot be adequately stirred in the reactor. After this time, the remaining 150 gm of latex (adjusted to a pH of 3.2) is added to the particle slurry and heating is continued for a further 90 minutes to ensure that the delayed latex is incorporated into the final aggregates.

Even after this elaborate procedure the number GSD of the particles is no better than 1.27. The pH of the slurry is then increased to 8.0 and heated to 90° C. After 30 minutes at 90° C., the temperature is raised to 93° C. and after 30 minutes the pH is decreased to 3.8 by the addition of a 5% w/w citric acid solution.

Under these conditions, the particles form almost spherical entities (with a shape factor of 125) after 10 hours heating.

Example Procedure (iii) (Total aggregation time at 48° C. to reach 5.2 microns is 2 hrs. 30 min.)

350 gm of latex and 60 gm of the wax dispersion are added to 300 gm of water and mixed well. 20 gm of pigment dispersion is added to 100 gm of water and added to the latex-wax blend. At this stage the solids content of the blend is 17% w/w. 1.5 gm of a 10% PAC solution in 10 gm of 0.2 N nitric acid is added slowly to the wax-pigment-latex blend while homogenizing at 5000 rpm. The blend at this stage had moderate viscosity and is transferred into a reactor and heated to a temperature of 48° C. The viscosity of the slurry increases as the temperature is raised, but addition of 50 gm of water allows the blend to be agitated sufficiently to ensure adequate temperature uniformity of the slurry.

After 30 minutes at the aggregation temperature, a particle size analysis shows the presence of some fines in the system. 1.0 gm of PAC solution and 50 gm of water is then added to the aggregating blend. After an additional 30 minutes, a further 0.5 gm of PAC is added to the slurry.

Finally, after an additional 30 minutes, the 150 gm of delayed latex is added and the slurry heated for one hour before the pH is increased to 8.0 and the slurry heated to 90° C. The number GSD of the sample at this time is determined to be 1.23. After 1 hour at 90° C., the pH of the slurry is decreased to 3.5 and after an additional hour the pH is further reduced to 2.5, and after 8 hours the particles had an almost spherical shape with a shape factor of 120.

Example 2

Toner preparation 310 gm of latex is simultaneously added with 20 gm of pigment dispersion having a solids loading of 45.3% to 600 grams of water while being homogenized. 1.5 gm of a 10% PAC solution in 10 gm of 0.2 N nitric acid is added slowly to the wax-pigment-latex blend while homogenizing at 5000 rpm. 1.5 grams of a cationic surfactant, dialkyl benzenealkyl ammonium chloride in 10 grams of water solution, is slowly added to the latex/pigment blend. Only half the portion of this co-coagulant is added since the viscosity increases and is just manageable by the homogenizer. The blend at this stage has moderate viscosity and is transferred into a reactor and heated to a temperature of 48° C. The viscosity of the slurry increases as the temperature is raised, but then slowly reduces after 1 hr at 48° C. A particle size measurement indicates that there are fines present. The second half of the cationic surfactant is then added slowly into the reactor. After an additional hour, the particle size measured is 5.2 micron with a GSD of 1.18. 80 grams of delayed latex is then added and the slurry is heated for an additional 30 mins at 48° C. The particle size measured at this stage is 5.4 microns with a GSD of 1.17. The pH of the slurry is then changed to 7.8 and the slurry heated to 90° C. After 1 hour at 90° C., the pH of the slurry is decreased to 4.5 and after 6 hours the particles have an almost spherical shape with a shape factor of 120 with the particle size of 5.5 and a GSD of 1.19.

Example 3

Preparation of a Green toner

A green toner (Pigment Green 7) is prepared in accordance with Example 2 except the particle size before the delayed latex is 5.7 microns with the GSD of 1.19. Upon the addition of the delayed latex, the size is 6.0 and a GSD of 1.18. The final coalesced particle size is 6.2 and the GSD is 1.19.

Example 4

Preparation of a Magenta toner

A magenta toner (Pigment Red 81.2) is prepared in accordance with Example 2 except the particle size before the delayed latex is 5.4 microns with the GSD of 1.18. Upon the addition of the delayed latex, the size is 5.5 and a GSD of 1.16. The final coalesced particle size is 5.7 and the GSD is 1.19.

Example 5

Preparation of an Orange toner

An orange toner (Pigment Orange 16) is prepared in accordance with Example 2 except the particle size before the delayed latex is 5.5 microns with the GSD of 1.17. Upon the addition of the delayed latex, the size is 5.6 and a GSD of 1.16. The final coalesced particle size is 5.8 and the GSD is 1.18.

Example 6

Preparation of a Green toner

A green toner (Pigment Green 36) is prepared in accordance with Example 2 except the particle size before the delayed latex is 5.7 microns with the GSD of 1.18. Upon the addition of the delayed latex, the size is 5.7 and a GSD of 1.17. The final coalesced particle size is 5.8 and the GSD is 1.18.

Example 7

Preparation of a Yellow toner

A yellow toner (Pigment Yellow 14) is prepared in accordance with Example 2 except the particle size before the delayed latex is 5.9 microns with the GSD of 1.20. Upon the addition of the delayed latex the size is 6.1 and a GSD of 1.19. The final coalesced particle size is 6.3 and the GSD is 1.20.

What is claimed is:

1. A process for the preparation of a toner composition comprising:

(i) forming a resin latex dispersion of a resin in an aqueous ionic surfactant solution from a latex utilizing an ionic surfactant and optionally a nonionic surfactant;

(ii) preparing a pigment dispersion in water of a pigment dispersed in water and a nonionic dispersant, and optionally an ionic surfactant of the same polarity as that employed in preparing the resin latex dispersion of step (i), (iii) blending the resin latex dispersion with the pigment dispersion, and optionally a wax dispersion, to form a resin-pigment blend;

(iv) adding a portion of a counterionic coagulant in an aqueous solution to the resin-pigment blend, while continuously subjecting the mixture to high shear, to induce a homogeneous gel of the resin-pigment blend, wherein the amount of the counterionic coagulant added is 25 to 90% by weight of a total amount of counterionic coagulant to be added during the process;

(v) heating the sheared gel at temperatures below a glass transition temperature (Tg) of the resin while continuously stirring to form aggregate particles;

(vi) following a period of time to permit stabilization of aggregate particle size, adding a remaining portion of the total amount of counterionic coagulant to be added during the process in one or more sequenced stages;

(vii) adjusting the pH with a pH increasing agent to stabilize the aggregate particles;

(viii) heating the aggregate particles at temperatures above the Tg of the resin followed by reduction of the pH to form coalesced particles of a toner composition; and (ix) optionally separating and drying the toner composition.

2. The process according to claim 1, wherein the ionic surfactant is an anionic surfactant and the counterionic coagulant is an organic cationic coagulant, an inorganic cationic coagulant or a combination of both.

3. The process according to claim 1, wherein the heating in step (v) is at a temperature of from 5° C. to 20° C. below the glass transition temperature (Tg) of the resin and the stirring is at speeds between 200 and 800 rpm.

4. The process according to claim 1, wherein the heating in step (viii) is conducted at a temperature of from 10° C. to 50° C. above the glass transition temperature (Tg) of the resin.

5. The process according to claim 1, wherein steps (i) to (vi) of the process are carried out within the pH range of from 2.0 to 3.5.

6. The process according to claim 1, wherein the adjusting the pH in step (vii) changes the pH from a range of 2.0 to 3.5 to a range of 6.0 to 8.0 in order to stabilize the aggregates.

7. The process according to claim 1, wherein the coalescence step (ix) is performed initially at a pH of 6.5 to 8.0, followed by a reduction in pH with a pH reducing agent to a pH of 3.0 to 4.5.

8. The process according to claim 1, wherein the process further comprises adding water during an addition of the counterionic coagulant.

9. The process according to claim 1, wherein the resin is selected from the group consisting of poly(styrene-butadiene), poly(para-methyl styrene-butadiene), poly(meta-methyl styrene-butadiene), poly(alpha-methylstyrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene) copolymers.

10. The process according to claim 1, wherein the cationic coagulant is selected from the group consisting of polyaluminum chloride, aluminum sulfate, zinc sulfate, alum, dialkyl benzenealkyl ammonium chloride and combinations of these.

11. The process according to claim 1, wherein the resin latex dispersion contains resin particles having an average size of less than 250 nm.

12. The process according to claim 1, wherein the high shear in step (iv) is from 3,000 to 10,000 rpm for 1 to 120 minutes.

13. The process according to claim 1, wherein the toner particles obtained have an average volume diameter of from 1.5 to 15 microns and a geometric size distribution of from about 1.05 to about 1.25.

14. A process for the preparation of a toner composition comprising:

(i) forming a resin latex dispersion of a resin in an aqueous ionic surfactant solution from a latex utilizing an ionic surfactant and optionally a nonionic surfactant;

(ii) preparing a pigment dispersion in water of a pigment dispersed in water and a nonionic dispersant, and optionally an ionic surfactant of the same polarity as that employed in preparing the resin latex dispersion of step (i);

(iii) blending 70 to 99% by weight of a total amount of the resin latex dispersion to be added during the process with the pigment dispersion, and optionally a wax dispersion, to form a resin-pigment blend;

(iv) adding a portion of a counterionic coagulant in an aqueous solution to the resin-pigment blend, while continuously subjecting the mixture to high shear, to induce a homogeneous gel of the resin-pigment blend, wherein the amount of the counterionic coagulant added is 25 to 90% by weight of a total amount of counterionic coagulant to be added during the process;

(v) heating the sheared gel at temperatures below a glass transition temperature (Tg) of the resin while continuously stirring to form aggregate particles;

(vi) following a period of time to permit stabilization of aggregate particle size, adding a remaining portion of the total amount of counterionic coagulant to be added during the process in one or more sequenced stages;

(vii) following completion of the adding of all of the counterionic coagulant, adding a remaining portion of the total amount of resin latex dispersion to be added during the process;

(viii) adjusting the pH with a pH increasing agent to stabilize the aggregate particles;

(ix) heating the aggregate particles at temperatures above the Tg of the resin followed by reduction of the pH to form coalesced particles of a toner composition; and (x) optionally separating and drying the toner composition.

15. The process according to claim 14, wherein the ionic surfactant is an anionic surfactant and the counterionic coagulant is a cationic surfactant.

16. The process according to claim 14, wherein the heating in step (v) is at a temperature of from 5° C. to 20° C. below the glass transition temperature (Tg) of the resin and the stirring is at speeds between 200 and 800 rpm.

17. The process according to claim 14, wherein the heating in step (ix) is conducted at a temperature of from 10° C. to 50° C. above the glass transition temperature (Tg) of the resin.

18. The process according to claim 14, wherein the blending and aggregation process is carried out within the pH range of from 2.0 to 3.5.

19. The process according to claim 14, wherein the process further comprises adding water during an addition of the counterionic coagulant.

20. The process according to claim 14, wherein the resin is selected from the group consisting of poly(styrene-butadiene), poly(para-methyl styrene-butadiene), poly (meta-methyl styrene-butadiene), poly(alpha-methylstyrene-butadiene), poly(methylmethacrylate-butadiene), poly(ethylmethacrylate-butadiene), poly (propylmethacrylate-butadiene), poly(butylmethacrylate-butadiene), poly(methylacrylate-butadiene), poly (ethylacrylate-butadiene), poly(propylacrylate-butadiene), poly(butylacrylate-butadiene), poly(styrene-isoprene), poly (para-methyl styrene-isoprene), poly(meta-methyl styrene-isoprene), poly(alpha-methylstyrene-isoprene), poly (methylmethacrylate-isoprene), poly(ethylmethacrylate-isoprene), poly(propylmethacrylate-isoprene), poly (butylmethacrylate-isoprene), poly(methylacrylate-isoprene), poly(ethylacrylate-isoprene), poly (propylacrylate-isoprene), and poly(butylacrylate-isoprene) copolymers.

21. The process according to claim 14, wherein the cationic coagulant is selected from the group consisting of poly-aluminum chloride, aluminum sulfate, zinc sulfate, alum, dialkyl benzenealkyl ammonium chloride and combinations of these.

22. The process according to claim 14, wherein the resin latex dispersion contains resin particles having an average size of less than 200 nm.

23. The process according to claim 14, wherein the toner particles obtained have an average volume diameter of from 1.5 to 15 microns and a geometric size distribution of from about 1.05 to about 1.25.

* * * * *